US006531033B1

(12) United States Patent
Kawashima

(10) Patent No.: US 6,531,033 B1
(45) Date of Patent: Mar. 11, 2003

(54) WET WEB TRANSFER BELT

(75) Inventor: Shin Kawashima, Abiko (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/679,981

(22) Filed: Oct. 5, 2000

(30) Foreign Application Priority Data

Oct. 25, 1999 (JP) ..... 11-303154

(51) Int. Cl.[7] ..... D21F 3/00; D04H 1/14

(52) U.S. Cl. ..... 162/306; 162/358.2; 442/270; 442/272; 442/274; 442/322

(58) Field of Search ..... 162/306, 289, 162/358.2, 358.3, 360.2, 901; 442/268, 101, 86, 270, 271, 272, 275, 322, 225, 323, 324, 388, 400, 274; 28/110, 112

(56) References Cited

U.S. PATENT DOCUMENTS 4,259,394 A * 3/1981 Khan ..... 428/229
4,565,735 A * 1/1986 Murka et al. ..... 428/234
5,298,124 A * 3/1994 Eklund et al. ..... 162/306
5,863,390 A * 1/1999 Matsuno ..... 162/358.2
6,136,151 A * 10/2000 Davenport et al. ..... 162/306
6,306,260 B1 * 10/2001 Kawashima ..... 162/306
6,319,365 B1 * 11/2001 Inoue ..... 162/306
6,340,413 B1 * 1/2002 Nilsson et al. ..... 162/361

FOREIGN PATENT DOCUMENTS

JP 60-88193 5/1985
JP 6-57678 3/1994

* cited by examiner

*Primary Examiner*—Steven P. Griffin
*Assistant Examiner*—Carlos Lopez
(74) *Attorney, Agent, or Firm*—Howson & Howson

(57) ABSTRACT

A wet web transfer belt for a closed draw papermaking machine is provided with a rough surface to allow easy release of a wet web. The rough surface is obtained easily, and with reliable quality, by forming the web-contacting side of a batt layer from a welded layer of meltable fiber. A filler is included in the surface portion of the welded layer, extending from the surface at least part way into the welded layer, thereby facilitating the production of projections and concavities which provide the rough surface, and resulting in a wet web transfer belt of stable quality.

8 Claims, 7 Drawing Sheets

FIG. 7

| | Composition | | | | Density | Air Permeability | Surface Roughness | Light-weighted-ness | Rewetting Preven-tion | Releas-anility |
|---|---|---|---|---|---|---|---|---|---|---|
| | Batt Layer 3a | *Proportion of Filler | Batt Layer 3b | Base | | | | | | |
| Example 1 | A Melta-ble 100%<br>B Melta-ble 100% | 30 | Melta-ble 80%<br>Univ. 20% | Upper 1/1 Plain weave 200 g/m² | 1 | less than 1 | 20 | △ | ◎ | ○ |
| Example 2 | A Melta-ble 100%<br>B Melta-ble 80%<br>Univ. 20% | 30 | Melta-ble 80%<br>Univ. 20% | | 0.95 | less than 1 | 20 | △ | ◎ | ○ |
| Example 3 | A Melta-ble 90%<br>Univ. 10%<br>B Melta-ble 80%<br>Univ. 20% | | Melta-ble 70%<br>Univ. 30% | Lower 1/3 3/1 broken | 0.90 | less than 1 | 26 | ○ | ◎ | ○ |
| Example 4 | A Melta-ble 80%<br>Univ. 20%<br>B Melta-ble 80%<br>Univ. 20% | 30 | Melta-ble 80%<br>Univ. 20% | Double weave 400 g/m² | 0.85 | 1 ~ 2 | 30 | ◎ | ○ | ◎ |
| Example 5 | A Melta-ble 80%<br>Univ. 20%<br>B Melta-ble 80%<br>Univ. 20% | 30 | Univ. 100% | | 0.85 | 1 ~ 2 | 30 | ◎ | ○ | ◎ |
| Example 6 | A Melta-ble 90%<br>Univ. 5%<br>Heat-r. 5%<br>B Melta-ble 80%<br>Univ. 20% | 30 | Melta-ble 80%<br>Univ. 20% | | 0.80 | 1 ~ 2 | 35 | ○ | ○ | ◎ |
| Example 7 | A Melta-ble 80%<br>Univ. 15%<br>Heat-r. 5%<br>B Melta-ble 80%<br>Univ. 20% | 40 | Melta-ble 80%<br>Univ. 20% | | 0.75 | 1 ~ 2 | 40 | △ | ○ | ◎ |
| Example 8 | A Melta-ble 80%<br>Univ. 20%<br>B Univ. 100% | 40 | Melta-ble 100% | | 0.65 | 2 | 50 | ◎ | △ | ◎ |

*Percentage of filler against areal weight of meltable fiber in layer A of batt layer 3a

FIG. 8

| | Composition | | | | Density | Air Permeability | Surface Roughness | Light-weighted-ness | Rewetting Preven-tion | Releas-anility |
|---|---|---|---|---|---|---|---|---|---|---|
| | Batt Layer 3a | Proportion of Filler | Batt Layer 3b | Base | | | | | | |
| Comp. 9 | A Univ. 100%<br>B Melta-ble 80%<br>Univ. 20% | 0 | Melta-ble 80%<br>Univ. 20% | Upper 1/1 Plain weave 200 g/m$^2$<br>Lower 1/3 3/1 broken Double weave 400 g/m$^2$ | 0.70 | 2 | 80 | ◎ | × | ◎ |
| Comp. 10 | A Melta-ble 20%<br>Univ. 80%<br>B Melta-ble 100% | 0 | Univ. 100% | | 0.60 | 4 | 70 | ◎ | × | ◎ |
| Comp. 11 | A Univ. 100%<br>B Univ. 100% | 0 | Univ. 100% | | 0.65 | 5 | 100 | ◎ | × | ◎ |
| Conv. 12 | Polyurethane resin coating (2600g/m$^3$) | 0 | None | Double weave (1000g/m$^2$) | 1.06 | 0 | 30 | × | ◎ | ○ |

WET WEB TRANSFER BELT

FIELD OF THE INVENTION

This invention relates to papermaking, and more particularly to a wet web transfer belt in a papermaking machine, wherein a wet web is transferred in a closed draw.

BACKGROUND OF THE INVENTION

In a conventional papermaking machine wherein a wet web is transferred in open draw, that is, the wet web is transferred without a support, the web is susceptible to rupture at the transfer points. The possibility of rupture places a limitation on the speed at which the papermaking machine may be run. Consequently, closed draw papermaking machines, i.e. machines in which the web is transferred with a support, are becoming more prevalent. Closed draw machines can be operated stably at higher speeds.

In a conventional closed draw papermaking machine, a pickup felt picks up a wet web from a preceding section of the machine, holding the web underneath the bottom surface of the felt and transferring it to a next stage transfer belt.

The wet web is then pinched between the pickup felt and a transfer belt at a first nip formed between a pair of press rolls. Water is squeezed out of the wet web at the first nip. The wet web is then released from the pickup felt and transferred to the transfer belt. The transfer belt carries the wet web to a second nip formed between a third press roll and a shoe press, where further water is drained from the web and picked up by a press felt.

The wet web remains on the transfer belt until it reaches a vacuum roll, where the web is transferred to a canvas belt for heating and drying.

The closed draw papermaking apparatus utilizes a number of transfer points. Therefore, it is important for the wet web to be released easily to avoid maloperation. It is especially important for the wet web to be released easily at the location immediately following the shoe press because, if the transfer belt is smooth, a continuous film of water is likely to be formed between the wet web and the transfer belt. The water film can cause the wet web to adhere so tightly to the transfer belt that it cannot be released, even by the force applied by the vacuum roll.

The problem of web releasability has been addressed by utilizing the technology disclosed in Japanese published unexamined patent applications 57678/1994 and 88193/1985.

In the case of application 57678/1994 a filler is mixed into a synthetic resin layer formed on the surface of a base layer. The synthetic resin layer is ground after the resin has cured, and the filler forms projections on its surface. These projections impart a roughness to the surface and are very effective in breaking up the water film formed between the web and the transfer belt.

In the case of application 88193/1985, a synthetic resin layer 32 is applied to the surface of a base layer 31 by spraying in such a way that numerous air bubbles are formed in the synthetic resin layer. Upon grinding of the synthetic resin layer after it is cured, the air bubbles at the surface produce a multitude of concavities. These concavities impart a roughness to the surface of the belt which is effective to break the water film between the transfer belt and a wet web carried thereby.

The projections and concavities on the surfaces of the belts of the prior art can be formed only by grinding the surface of the synthetic resin layer after it has been cured. Especially in the case of the prior art belt of Japanese application 57678/1994, grinding must be carried out with a grinding tool operating against a rotating belt under a specific tension. In the grinding operation, there is a likelihood that fillers will be inadvertently scooped out, and consequently it is difficult to obtain a wet web transfer belt having the desired qualities.

Both of the above-mentioned prior art belts, which are composed of a base layer and a synthetic resin layer, tend to be heavy and difficult to install in a papermaking machine, depending on the structure and surroundings of the machine.

This invention is intended to solve the above-mentioned problems all at once. An important object of the invention is to provide a wet web transfer belt from which the wet web can be released easily at transfer points in a closed draw papermaking machine, and to provide a wet web transfer belt which can be easily installed.

SUMMARY OF THE INVENTION

The invention achieves the aforementioned objects in a wet web transfer belt for a papermaking machine wherein a wet web is transferred in a closed draw, the belt comprising a base layer and a batt layer, wherein the batt layer has a surface on which a wet web is placed, the surface being formed of fiber comprising a welded layer of meltable fiber, the welded layer including a filler which extends at least to said surface. The above belt structure makes it possible to obtain a desired surface roughness of superior quality, easily and reliably.

In a preferred embodiment, in order to prevent rewetting by keeping water from migrating deep into the belt, the welded layer has an air permeability of 2 $cc/cm^2/sec.$ or less.

The preferred surface roughness of the welded layer is in the range of Rz5–80 $\mu m$ in order that the water film formed between the wet web and the belt can be broken easily.

In accordance with a preferred embodiment of the invention, the hardness of the filler is higher than that of the welded layer, thereby enabling the filler to bite into the relatively soft welded layer of the meltable fiber, when compressed.

Other objects, details and advantages of the invention will be apparent from the following detailed description when read in conjunction with the drawings.

BRIEF DESCRIPTION OF THE DRAWINGS

FIG. 5(*b*) is a similar view, illustrating the application of pressure to the wet web;

FIG. 5(*c*) is a similar view illustrating the condition of the wet web after pressure is released;

FIG. 7 is a table summarizing the performance of working examples 1–8;

FIG. 8 is a table summarizing the performance of comparative examples 9–11;

FIG. 9(*b*) is an enlarged cross-sectional view of a conventional belt in which a filler is mixed into a synthetic resin layer; and FIG. 9(*c*) is an enlarged cross-sectional view of a conventional belt in which air bubbles are mixed into a synthetic resin layer.

DETAILED DESCRIPTION

Figure 9A:
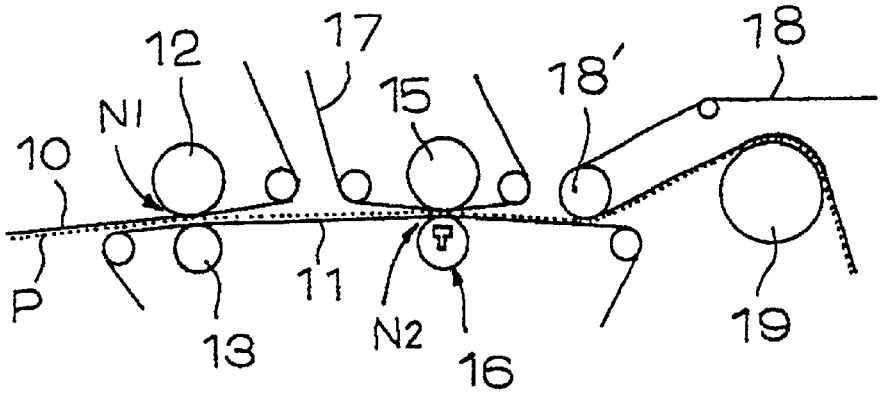
FIG. 9(*a*) is a schematic view of a closed-draw paper-making machine.
Figure 9B:
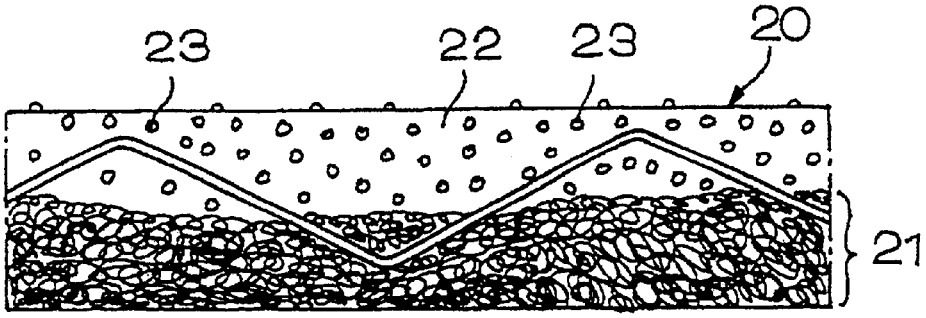
FIG. 9B PRIOR ART
Figure 9C:
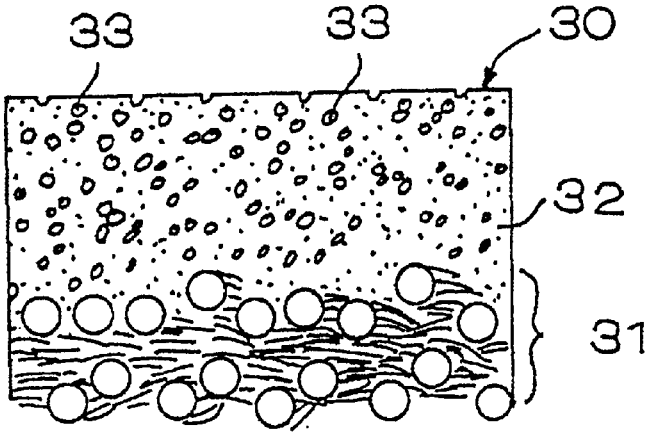
FIG. 9C PRIOR ART

FIG. 9(*a*) shows the main part of a closed draw paper-making machine. A pickup felt 10 picks up a wet web P from a preceding section of the machine, for example the wire section (not shown), holding the web underneath the bottom surface of the felt and transferring it to a next stage transfer belt 11. The pickup felt therefore functions as a support for the wet web P.

The wet web P is pinched between the pickup felt 10 and the transfer belt 11 at a first nip N1 formed between first and second press rolls 12 and 13. Pressure is applied to the wet web at the nip N1, squeezing water out of the wet web. After passing through the first nip N1, the wet web P is released from the pickup felt 10 and transferred to the web transfer belt 11. The belt 11, in turn, carries the wet web to a second nip N2, formed between a third press roll 15 and a shoe press 16. The pressure applied to the wet web P at nip N2 further drains water from the web. The water squeezed out of the wet web at nip N2 moves to a press felt 17.

When pressure is released from the wet web P after it passes through nip N2, the wet web remains on transfer belt 11 until it reaches vacuum roll 18'. At the vacuum roll, the web is transferred, by a vacuum applied inside the vacuum roll, to a canvas belt 18, which passes around the vacuum roll. While on the canvas belt, the web is heated and dried by a heating cylinder 19.

Especially at the location immediately following the shoe press, i.e., the location following the second nip N2, if the transfer belt 11 is smooth, a continuous film of water is likely to be formed between the wet web P and the transfer belt. The water film can cause the wet web P to adhere so tightly to the belt 11 that it cannot be released from belt 11, even by the force applied by the vacuum roll 18'.

A belt disclosed in Japanese published application 57678/1994 is depicted in FIG. 9(*b*) as belt 20. In this belt, a filler 23 is mixed into a synthetic resin layer 22 formed on the surface of a base layer 21. The filler has a hardness greater than that of the synthetic resin. When the layer 22 is ground after the synthetic resin has cured, the filler forms projections on the surface of the layer 22. These projections impart a roughness to the surface of layer 22 and are very effective in breaking up the water film formed between the web and the transfer belt.

A belt disclosed in Japanese published application 88193/1985 is depicted in FIG. 9(*c*) as belt 30. A synthetic resin layer 32 is applied to the surface of a base layer 31 by spraying in such a way that numerous air bubbles 33 are formed in the synthetic resin layer. Upon grinding of the synthetic resin layer after it is cured, the air bubbles at the surface produce a multitude of concavities. These concavities impart a roughness to the surface of the belt which is effective to break the water film between the transfer belt and a wet web carried thereby.

As mentioned previously, the projections and concavities on the surfaces of the belts of the prior art can be formed only by grinding the surface of the synthetic resin layer after it has been cured. The need for curing and grinding results in a high production cost. Especially in the case of the prior art belt 20 of FIG. 9(*b*), grinding must be carried out using a grinding tool set against a rotating belt running under a specified tension. Therefore, there is a likelihood that fillers will be inadvertently scooped out, which makes it difficult to obtain a wet web transfer belt having the desired quality.

Furthermore, the prior art belts 20 (FIG. 9(*a*)) and 30 (FIG. 9(*b*)) are composed of a base layer and a synthetic resin layer and tend to become heavy, which makes it difficult to install them in a paper-making machine, depending on the structure and surroundings of the machine.

Several embodiments of the invention will now be described with reference to FIGS. 1–5.

Figure 1:
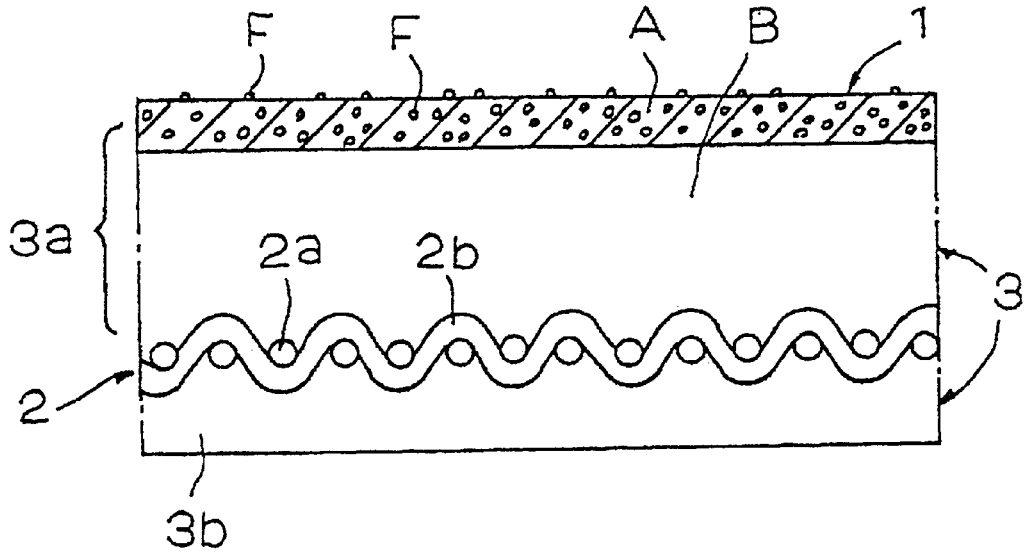
FIG. 1 is an enlarged cross-sectional view of a wet web transfer belt in accordance with a first embodiment of the invention, in which a meltable fiber is used only in the surface layer of the side on which a wet web is placed.

In FIG. 1, the transfer belt of the invention, generally referred to by reference numeral 1, comprises a base layer 2 and a batt layer 3. The batt layer 3 is intertwined and integrated into the base layer 2 by needle punching, and a filler F is provided in the batt layer 3, but only in the surface layer A thereof. A part of the filler is exposed, protruding from the surface which is adapted to carry a wet web.

The base layer 2 consists of a ground fabric having a woven structure made up of a warp yarn 2*a* and a weft yarn 2*b*. Monofilament single yarns, monofilament twisted yarns, and multifilament yarns may be used as the warp yarns and as the weft yarns. The woven structure can be a single weave, a double weave or a triple weave selected singly or provided in a piled combination. The base layer preferably has a basic areal weight of 300–800 g/m$^2$.

The batt layer 3 is composed of two sides: a side 3*a* on which a wet web is placed and a roll contact side 3*b* which is contacted by the press roll of a papermaking machine. Preferably, the total basic weight of the batt layer 3 is 600–1200 g/m$^2$. It is preferable that the basic weight and apparent density of a completed belt according to the invention be regulated to 900–2000 g/m$^2$ and 0.40–0.99 g/cm$^3$, respectively.

In the transfer belt 1 shown in FIG. 1, at least the surface layer A (the cross-hatched part of side 3*a*, on which the wet web is placed) is formed either substantially entirely of a meltable fiber, or of a mixture of a meltable fiber and a non-meltable fiber. The middle layer B (the non-hatched part), as well as the roll-contacting side 3*b* are composed of a non-meltable fiber.

The term "meltable fiber" as used herein refers to a fiber the whole or a part of which is melted at a temperature in the range from 120° C.–180° C. For example, a copolymerized nylon, which includes nylon 11, nylon 12, nylon 6 and nylon 66, etc. may be used. On the other hand the term "non-meltable fiber" refers to a fiber which is not meltable in the temperature range in which the meltable fiber is melted. For instance, universal fibers and heat-resistant fibers which are generally used in conventional press felts are "non-meltable fibers." It is preferable that the heat-resistant fibers have a melting point higher than that of universal fibers by 20° C.

or more. Specifically, PPS, PEEK, PEK, all aromatic polyesters and aromatic polyamides, etc. which have melting points of 280° C. or higher can be employed either alone or in mixtures.

The filler F is included in the surface layer A, and a part of the filler F protrudes from the surface. The filler F comprises organic or inorganic particles or a mixture of organic and inorganic particles. The inorganic particles may include mineral products such as kaolin, activated clay, silica sand, silica, diatomaceous earth, talc, pearlite, bentonite, and so forth. The organic particles may include thermosetting resins such as epoxy resins, xylene resin, phenol resin, unsaturated polyester resin, polyimide resin, polyurethane resin, melamine resin, urea resin and so on.

When incorporating the filler F into the surface layer A, it is necessary to combine the meltable fiber with the filler F before welding of the meltable fiber takes place. There are no limitations to the ways in which this can be done, but generally either a wet type or dry type method may be employed. In the wet type method the filler is dispersed in water, and the dispersion is applied to the batt forming the surface layer A. In the dry type method, static electricity or a sieve may be employed. The process of incorporating the filler F into the batt may be carried out either before or after the batt fiber and the base layer are intertwined and integrated with each other.

If the welded layer is formed after the meltable fiber at surface A is welded by heat, the air permeability of side 3*a* is reduced. Therefore, less water permeates into the belt 1, effectively preventing the phenomenon of rewetting.

If the meltable fiber is melted completely, the fibrous configuration is lost, and the air permeability of side 3*a* becomes zero. This prevents rewetting, and also makes the surface of the belt smooth, which is useful for making high quality paper. However, complete melting is not preferred because it prevents the wet web from being released easily. It is important not to melt the meltable fiber completely, so that the fibrous configuration is retained to some extent and projections and concavities are formed on the side 3*a* on which the wet web is placed.

If the surface layer A on side 3*a* is made of a mixture of a meltable and a non-meltable fiber, the non-meltable fiber remains as a fiber without melting even if heat is such that the meltable fiber melts completely. Therefore in the case of a mixture of meltable and non-meltable fibers, projections and concavities can be formed easily on the side of the belt on which the wet web is placed. The belt can be made flexible and more durable by the use of a mixture of fibers.

In the invention, the filler F protrudes from the surface layer A to ensure the formation of projections and concavities. But, as mentioned above, a fibrous structure is preferably retained within the surface layer A. This gives the filler particles in the surface layer a greater degree of freedom than is the case in the prior art structure of FIG. 9(*b*). Thus, the flexibility of the belt is maintained and its weight is not significantly increased. The flexibility and light weight make the belt easy to install in a paper making machine.

Furthermore, according to the invention, the filler F is retained by the welded layer of a meltable fiber, so that the filler F, having a greater hardness than that of the welded layer, may be allowed to bite into the softer, fibrous welded layer. In contrast, in the prior art, as illustrated in FIG. 9(*b*), the filler is held firmly within the synthetic resin layer. Therefore, in the case of the invention, markings imparted to the wet web by the filler may be avoided. Moreover, the invention obviates any concern that the filler particles may be scooped out of the surface layer by grinding, since the need for grinding is eliminated.

Figure 2:
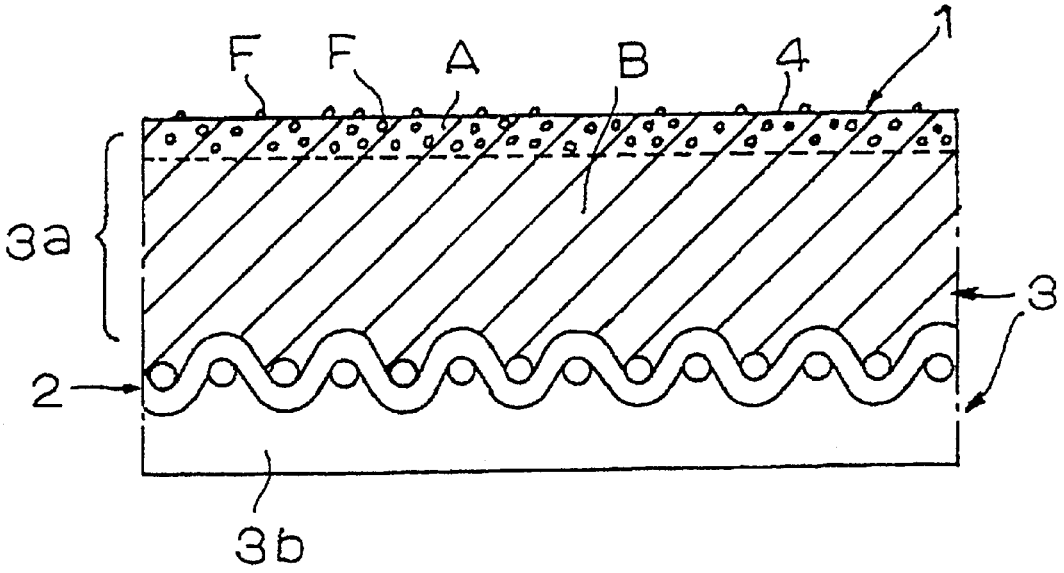
FIG. 2 is an enlarged cross-sectional view of a wet web transfer belt in accordance with a second embodiment of the invention, in which a meltable fiber is used in the entire part of the side of the belt on which a wet web is placed.

In the belt illustrated in FIG. 2, the entire side 3*a*, illustrated by cross-hatching, including not only the surface layer A but also the middle layer B of the batt layer 3 on which a wet web is placed, is made of a meltable fiber substantially by itself or of a mixture of meltable and non-meltable fibers. The roll contact side 3*b* is made of non-meltable fibers only. In this case, as in the case of the belt of FIG. 1, projections and concavities are formed on the surface when the meltable fiber in the surface layer A is welded by heat, forming a welded layer 4, and the filler F within the surface layer A is caused to protrude from the surface.

Figure 3:
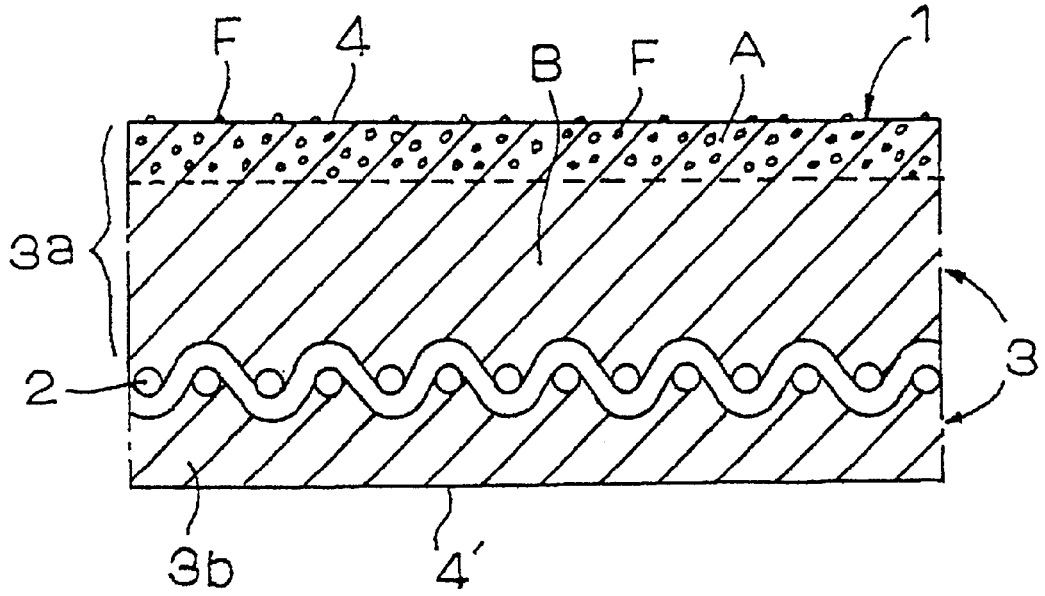
FIG. 3 is an enlarged cross-sectional view of a wet web transfer belt in accordance with a third embodiment of the invention, in which the entire batt layer is composed of a meltable fiber.

In the belt illustrated in FIG. 3, the entire side 3*a*, on which the wet web is placed, as well as the roll contacting side 3*b*, are composed of a meltable fiber or a mixture of a meltable and non-meltable fiber. In this case, as in the case of the belts of FIGS. 1 and 2, projections and concavities are formed on the surface when the meltable fiber in the surface layer A of side 3*a* is welded by heat to form a welded layer 4, and the filler F within the surface layer is caused to protrude from the surface. Further, a welded layer 4' may be formed on the roll contacting side 3*b*, so that the air permeability of the roll contacting side can also be regulated.

Figure 4:
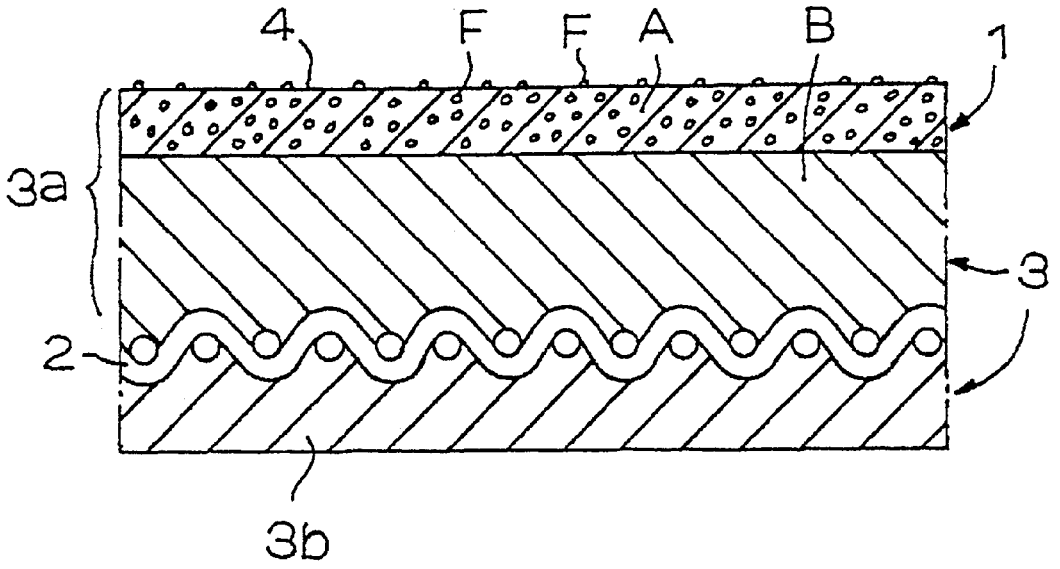
FIG. 4 is an enlarged cross-sectional view of a wet web transfer belt in accordance with a fourth embodiment of the invention, in which a meltable fiber is mixed, in different proportions, in each layer forming the batt layer.

In the belt illustrated in FIG. 4, meltable fiber and non-meltable fiber are mixed in different proportions in the surface layer A, the middle layer B of side 3*a* and the layer on the roll contacting side 3*b* respectively. These three layers are distinguished from one another in the drawing by cross-hatching in different directions. For example, the surface layer A, on which the wet web is placed, may be composed of 100% meltable fibers, whereas in the roll contacting side, meltable and non-meltable fibers can be present in a mixture consisting of 50% meltable fibers and 50% non-meltable fibers. In another example, meltable fibers and non-meltable fibers can be present in the ratio of 50% each in the surface layer A and the middle layer B, while in the roll-contacting side 3*b*, the mixture can consist of 80% meltable fibers and 20% non-meltable fibers. In this case as well, the meltable fibers in the surface layer of the roll contacting side 3*a* form a welded layer 4 having projections and concavities, and a part of the filler F within the surface layer 4 is caused to protrude from the surface of that layer.

If a greater proportion of meltable fiber is present in a mixture of meltable and non-meltable fibers, the belt becomes harder and more durable when the fibers are welded. On the other hand, with a lesser proportion of meltable fiber in the mixture, the belt can be made more flexible after welding, and therefore more easily installed. The proportion of meltable and non-meltable fibers may be determined by taking these factors into account.

The proportion of the filler F incorporated into the surface layer A of the belt 1 shown in FIGS. 2 to 4 should preferably be determined depending on the areal weight of the fiber batt. For example, if the areal weight of the meltable fibers within the surface layer A is 210 g/m$^2$, the amount of the filler F is preferably 15% thereof (i.e., 210×15%=32 g/m$^2$). The proportion of the filler F should be appropriately determined by taking into account the needed properties of the belt, which in turn depend on the required quality of the paper to be produced. The proportion of filler should be in the range from 5% to 50% weight % of the amount of the meltable fibers.

In the embodiments of the belt according to the invention illustrated above, projections and concavities in the wet web-contacting surface of the belt are formed when the meltable fibers of the web-contacting layer are welded by heat to form a welded layer, and are also formed as a result of the exposure of a part of the filler F within the surface layer A. The air permeability of the welded layer is preferably regulated so that it is not greater than 2 cc/cm$^2$/sec. Furthermore, since the projections and concavities of the welded layer greatly affect the ease with which a wet web is released after passing through a nip press, the surface roughness of the welded layer should be regulated at Rz5–80 $\mu$m.

The air permeability was measured by A method (fragile type testing machine) standardized in "JIS L 1096 (Testing Methods for Fabrics)", and surface roughness was measured by a method shown in "JIS B0601-1982".

Figure 5A:
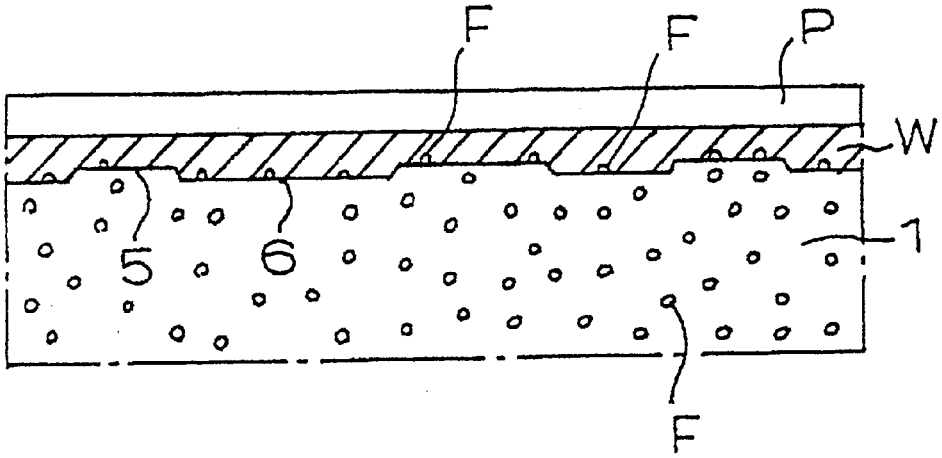
FIG. 5(*a*) is an enlarged cross-sectional view of a belt according to the invention, illustrating a wet web placed on the belt.
Figure 5B:
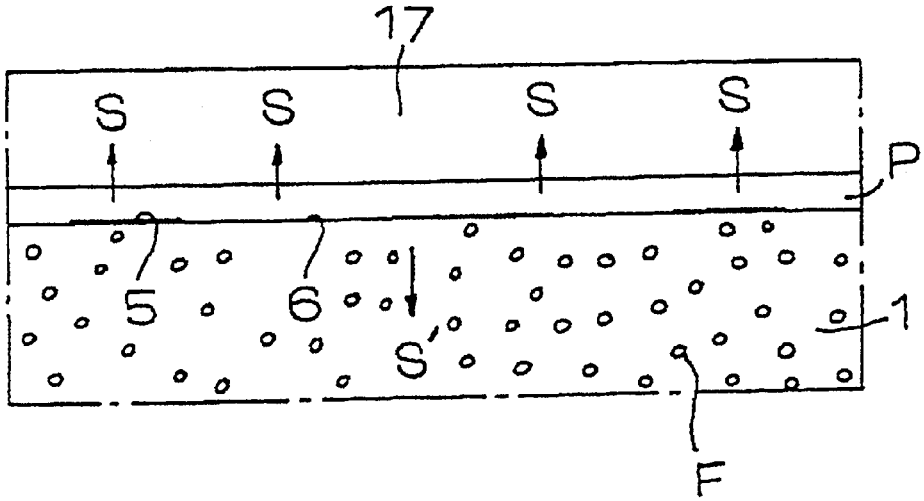
Figure 5C:
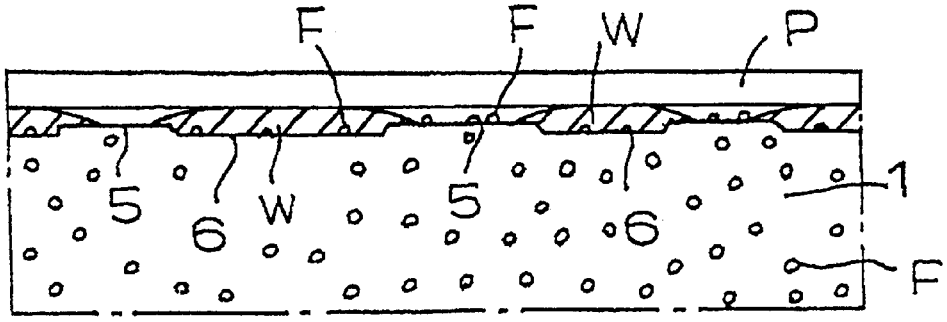

The effect of the belt according to the invention is illustrated in FIGS. 5(*a*)–5(*c*). As shown in FIG. 5(*a*), a wet web P is placed on the surface of the side 3*a* of the belt 1 having surface projections 5 and surface concavities 6, a water film W is formed between the surface of the belt and the wet web P by water drained from the wet web.

As shown in FIG. 5(*b*), when pressure is applied to the belt by a nip press consisting of a press roll and a shoe press (e.g. at nip location N2 in FIG. 9(*a*)) the projections 5 and concavities 6 are flattened because of the flexibility of the materials. Therefore, no markings are imparted to the wet web P by the projections and concavities. As shown by arrow S, water which is squeezed out of the wet web P by the nip press is caused to move into a press felt 17.

Since the air permeability of the belt is regulated at 2 cc/cm$^2$/sec or less, little water which is squeezed from the wet web P moves into the belt in the direction of arrow S'. Therefore, rewetting of the web when it is released from the nip press is prevented.

After release of pressure applied by the nip press, projections 5 and concavities 6 are restored on the surface of the belt. The water film W (illustrated by cross-hatching in FIGS. 5(*c*)) is broken. Therefore the wet web P will not adhere to the surface of belt 1, and can be easily released by suction at a vacuum roll 18' (FIG. 9(*a*)) so that it adheres to canvas belt 18.

As the filler F is exposed at the surface of the belt, the differences of height of the projections and the differences in depth of the concavities can be made significantly larger than in the case of the prior art. Thus, the breaking of the water film can be performed more smoothly.

Figure 6:
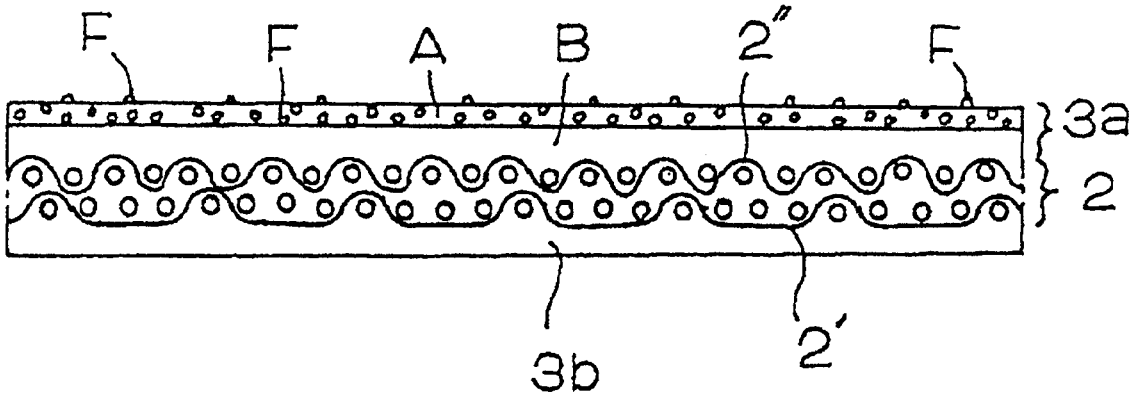
FIG. 6 is a schematic cross-sectional view of a basic form of belt for reference in the description of the working examples and comparative examples.

Referring to FIGS. 6, a specific example of a wet web transfer belt in accordance is constructed as follows. A base layer 2 (600 g/m$^2$) was formed by piling a second (upper) ground fabric (200 g/m$^2$) 2" on a first (lower) ground fabric (400 g/m$^2$) 2'. In the upper ground fabric twisted yarns, made by twisting three monofilaments of nylon 6 (0.2 mm in diameter), were woven into a single plain weave as warp yarns and weft yarns. In the lower ground fabric, the same yarns were woven into an endless 3/1 broken weave. The roll contact side 3*b* was formed by needle-punching batt fibers (300 g/m$^2$) piled on the first ground fabric 2' of the base layer 2. Then the base layer was turned over, and the side 3*a*, on which a wet web is placed, was formed by piling and needle-punching the batt fibers of the middle layer B (300 g/m$^2$) and the surface layer A (300 g/m$^2$) on the second ground fabric 2". As will be described later, the side 3*a*, on which a wet web is placed, is composed substantially entirely of meltable fibers or of a mixture of meltable fibers and universal or heat-resistant fibers.

Thereafter, the side 3*a* was sprayed with a dispersion of filler F in liquid so that the filler was include din a dispersed state within the surface layer A. Then the side 3*a*, i.e. the wet web contacting side, was placed into contact with a press roll heated to 170° C., and heat was conducted deep into the belt. (As an alternative, the side 3*a* can be heated by blowing hot air onto it.) The meltable fiber was melted and welded by the heat, and became film-like to form a welded layer. The air permeability of the welded layer was regulated to be 2 cc/cm$^2$/sec or less.

Examples are compared in FIGS. 7 and 8. The table of FIG. 7 illustrates eight examples in which the meltable fiber was mixed at different ratios in the surface layer A, the middle layer B of the web-contacting side 3*a* of the batt layer, and in the roll-contacting side 3*b* respectively. In these eight examples, the density, air permeability and surface roughness were regulated as shown in the table. The table of FIG. 8 illustrates comparative examples. One comparative example, example 9, is a belt in which meltable fiber was not used in the web-contacting side. Comparative examples 10 and 11 are belts in which the air permeability was greater than 2 cc/cm$^2$/sec. Comparative example 12 is a conventional belt of a closed-draw papermaking machine.

The tables compare the performance of the belt in three aspects: weight (which affects ease of installation); rewetting; and ease of release. The symbol × indicates poor performance, Δ indicates fair performance, ○ indicates good performance and ◎ indicates excellent performance. It should be noted that a filler was not utilized in the surface layers of the comparative examples 9–11, nor was it utilized in the conventional belt of example 12.

According to the tables, examples 1 and 2, wherein the surface of the web-contacting side 3*a* was composed of 100% meltable fibers, are evaluated as Δ (fair) in weight, which is the same as example 7, worse than examples 3–8 and the comparative examples 9–11, but not as bad as the conventional belt of example 12, which is evaluated as × (poor).

Examples 1–3 are evaluated as ◎ (excellent) with respect to rewetting prevention, which is better than examples 4–8. Insofar as rewetting prevention is concerned, the comparative belts of examples 9–11 were evaluated as × (poor), but the conventional belt performed excellently (◎).

Insofar as releasability is concerned, examples 4–8 and the comparative belts 9–11 exhibited excellent performance (◎). Examples 1–3 and the conventional belt of example 12, functioned well (○).

In summary, from the tables, it will be apparent that examples 1–8 have no poor (×) evaluations insofar as weight, rewetting and releasability are concerned. On the other hand, each of the comparative belts has a poor (×) evaluation in one of the three categories. Thus belts of examples 1–8 are superior to the others as a whole.

As described above, the wet web transfer belt of the invention, in which at least a surface of the side of the batt layer on which a wet web is placed is formed by a meltable fiber, produces an excellent effect in that a rough surface can be formed on the belt with reliable quality by regulating heat applied in welding the meltable fiber or by regulating the proportion of meltable and non-meltable fibers. With a surface roughness of Rz5–80 $\mu$m, the water film formed between the wet web and the belt can be broken easily so that the wet web can be readily released from the belt following passage through the nip press. Moreover, owing to the presence of the filler, formation of projections and concavities on the surface of the belt may be facilitated. Furthermore, the belt can be made light in weight, and is superior in that it allows a wet web to be released easily in a closed-draw papermaking machine. Moreover, by regulating air permeability so that it is 2 cc/cm$^2$/sec or less, the belt can be formed so that it water squeezed out of the wet web can be kept from moving deep into the belt, and in this way rewetting of the web is effectively prevented.

Finally, the hardness of the filler is greater than hat of the surface layer of the wet web transfer belt. Therefore, the filler held by the welded layer may be allowed to bite into the relatively soft welded layer, and consequently, markings imparted to the wet web by the filler may be avoided, and the filler will not be scooped out of the surface of the belt as was the case in the past.

What is claimed is:

1. A wet web transfer belt for a papermaking machine wherein a wet web is transferred in a closed draw, the belt comprising a base layer and a batt layer, the batt layer having a surface on which a wet web may be placed, wherein said surface of the batt layer is formed of fiber comprising a welded layer of meltable fiber, and said welded layer includes a filler which extends from said surface at least part way into the welded layer, wherein projections and concavities are formed on the surface of said welded layer of said meltable fiber due to a fibrous configuration and said filler, said projections and concavities being capable of flattening when a nip pressure is applied, and wherein the welded layer has an air permeability of 2 cc/cm$^2$/sec. or less.

2. A wet web transfer belt according to claim 1, wherein the welded layer has a surface roughness of Rz5–80 $\mu$m.

3. A wet web transfer belt according to claim 1, wherein said filler having a hardness higher than that of said welded layer.

4. A wet web transfer belt according to claim 1, wherein the welded layer has a surface roughness of Rz5–80 $\mu$m and said filler having a hardness higher than that of said welded layer.

5. A wet web transfer belt for a papermaking machine wherein a wet web is transferred in a closed draw, the belt comprising a base layer and a batt layer, the batt layer having a surface on which a wet web may be placed, wherein said surface of the batt layer is a welded layer formed of meltable fiber or of a mixture of meltable fiber and non-meltable fiber, and said welded layer includes a filler which extends from said surface at least part way into the welded layer, wherein projections and concavities are formed on the surface of said welded layer of said meltable fiber due to a fibrous configuration and said filler, said projections and concavities being capable of flattening when a nip pressure is applied, and wherein the welded layer has an air permeability of 2 cc/cm$^2$/sec. or less.

6. A wet web transfer belt according to claim 5, wherein the welded layer has a surface roughness of Rz5–80 $\mu$m.

7. A wet web transfer belt according to claim 5, wherein said filler having a hardness higher than that of said welded layer.

8. A wet web transfer belt according to claim 5, wherein the welded layer has a surface roughness of Rz5–80 $\mu$m and said filler having a hardness higher than that of said welded layer.

* * * * *